US008858262B2

(12) United States Patent
Daughtry, Jr. et al.

(10) Patent No.: US 8,858,262 B2
(45) Date of Patent: Oct. 14, 2014

(54) F-CONNECTOR WITH INTEGRATED SURGE PROTECTION

(71) Applicant: Genesis Technology USA, Inc., Norcross, GA (US)

(72) Inventors: Earl Anthony Daughtry, Jr., Lawrenceville, GA (US); Ronald L. Hodge, Flowery Branch, GA (US)

(73) Assignee: Genesis Technology USA, Inc., Norcross, GA (US)

( * ) Notice: Subject to any disclaimer, the term of this patent is extended or adjusted under 35 U.S.C. 154(b) by 38 days.

(21) Appl. No.: 13/693,352

(22) Filed: Dec. 4, 2012

(65) Prior Publication Data

US 2014/0154922 A1 Jun. 5, 2014

(51) Int. Cl.
*H01R 13/648* (2006.01)
*H01R 13/66* (2006.01)

(52) U.S. Cl.
CPC ..... *H01R 13/6666* (2013.01)
USPC ..... 439/620.03

(58) Field of Classification Search
USPC ..... 439/620.01–620.25
See application file for complete search history.

(56) References Cited

U.S. PATENT DOCUMENTS 4,784,618 A * 11/1988 Sakamoto et al. ..... 439/620.1
4,995,834 A * 2/1991 Hasegawa ..... 439/620.11
5,276,415 A * 1/1994 Lewandowski et al. ..... 333/260
5,340,325 A * 8/1994 Pai ..... 439/188
5,413,504 A * 5/1995 Kloecker et al. ..... 439/620.03
6,751,081 B1 * 6/2004 Kooiman ..... 361/119
7,094,104 B1 * 8/2006 Burke et al. ..... 439/620.01
7,479,035 B2 1/2009 Bence et al.
7,670,182 B2 * 3/2010 Morikawa ..... 439/620.03
8,174,132 B2 * 5/2012 Van Swearingen ..... 257/798
8,624,689 B2 * 1/2014 Hsieh et al. ..... 333/185
2004/0219838 A1 * 11/2004 Kooiman ..... 439/620
2006/0046571 A1 * 3/2006 Kosmala ..... 439/620
2009/0093160 A1 * 4/2009 Hsieh et al. ..... 439/620.1
2013/0273775 A1 * 10/2013 Chien ..... 439/620.01

* cited by examiner

*Primary Examiner* — Gary Paumen

(74) *Attorney, Agent, or Firm* — Hope Baldauff, LLC

(57) ABSTRACT

A connector (200), such as but not limited to a coaxial female F-connector, has an integral surge protector. The F-connector includes a connector body (220) with an extended center conductor lead (215). Attached to the F-connector and substantially surrounding the lead is an inductor, such as a toroid core (300) having windings (315) thereon. In one configuration one end (320) of the windings is attached to the center conductor lead and the other end (325) is attached to an electrical ground. In another configuration that other end is attached to a circuit ground via a capacitor, a power supply, or a biasing circuit. The inductor serves to shunt a surge to ground. A series capacitor is connected between the center conductor lead and an input/output port on an electronic circuit, passes the desired signal, and further helps to prevent a surge from reaching the device.

18 Claims, 7 Drawing Sheets

F-CONNECTOR WITH INTEGRATED SURGE PROTECTION

BACKGROUND

Many electronic devices require connections to other devices for input and/or output of power and/or signals. Coaxial cable is frequently used in the delivery of communication signals, including RF, data, video, and audio signals. For example, consumers frequently encounter coaxial cables in conjunction with residential cable television service applications (e.g., set top boxes, television sets, computers, etc.), and industry typically encounters coaxial cables with communication, security, and computer networks (e.g., WANs, LANs, panel boxes, control panels, etc.)

A common configuration of a coaxial cable comprises a center conductor which is typically a solid copper wire, a dielectric insulator which surrounds the center conductor and is typically made of foam or plastic, a shield which surrounds the dielectric insulator and which prevents RF energy from radiating outside the coaxial cable, and an insulating jacket which may be used to protect the other components of the coaxial cable from exposure to harsh weather and/or abusive conditions, and/or to reduce the chance of an electrical shock to a user. Normally, the shield is kept at ground potential and the signal is applied to the center conductor. Although such a coaxial cable may be hard-wired to an electronic device or component, it is more common to connect the cable to the electronic device using connectors, one on the electronic device, and the other on an end of the coaxial cable. In addition to communications signals, a coaxial cable may deliver DC power to or from device circuitry. Typically, but not necessarily, the cable has the male connector and the device has the female connector. One common connector used for connecting coaxial cable 100 to an electronic device is known as a coaxial "F-connector."

FIG. 1 is an illustration of a conventional cable connection system showing a cable 100, such as a coaxial cable, connected to an electronic device 110, such as but not limited to a cable television receiver, located inside a structure 115, such as a home or building. In many areas the cable 100 is attached to a utility pole 105 for above-ground entry into the structure 115 whereas, in other areas, the cable 100 may be routed below-ground 125 for entry into the structure 115 near or below grade.

Regardless of whether the cable installation is above-ground or below-ground, such cables can carry electrical surges, which are typically caused by, for example but not limited to, nearby lightning 120 strikes, electrical faults, or other events which generate a strong electromagnetic field. Such events can generate surge voltages and currents (referred to herein as a "surge" or "surges") in ranges which can easily damage sensitive electronic circuitry in devices 110 connected to the cable 100. In the past, attempts have been made to reduce these surges by connecting the cable 100 to, for example, the input of a surge suppressor device (not shown) or an uninterruptible power supply (UPS) (not shown) which includes a surge suppressor, and then connecting the output thereof by a short cable (not shown) to the electronic device 110. The surge suppressor or UPS absorbs or blocks most or all of the surge voltage, depending upon the magnitude of the surge voltage, and the short connecting cable minimizes any surge voltages which might be induced after the surge suppressor or UPS. These conventional surge suppressors and UPS devices can be large, typically require a good connection to ground, require an additional cable, and generally increase the cost and space requirements associated with the electronic device. Furthermore, the level of surge protection provided by such devices is not needed for the most common surges, and the most common surges may be below the amplitude or duration level which triggers the surge suppression feature of such devices but may still be of sufficient amplitude and/or duration to damage the sensitive input circuitry of many electronic devices.

SUMMARY

This Summary is a brief and/or simplified introduction to some of the concepts that are described below in the Detailed Description. This Summary is not intended to identify key features or essential features of the claimed subject matter, nor is it intended that this Summary be used to limit the scope of the claimed subject matter. Also, a particular implementation may solve all disadvantages noted with respect to the prior art, or may only solve one or more of such disadvantages. A connector having integrated surge protection to protect a device, a connector system having integrated surge protection to protect a device, and a coaxial connector system for providing surge protection to a device, are disclosed herein. The use of a connector with a surge-suppressing inductor mounted thereon provides benefits in efficiency of surge suppression, in reduction of interference, and in savings in manufacturing printed circuit boards for use in electronic devices which have an input or output which is connected to a cable.

A connector has integrated surge protection to protect a device. The connector includes a conductive connector body having a front end and a back end, a signal conductor positioned inside the connector body and extending from the front end to, and out of, the back end, at least one insulator positioned inside the connector body to electrically isolate the signal conductor from the connector body, and an inductor positioned either at the back end or in a recessed area in the back end. One end of the inductor is connected to the signal conductor. The other end of the inductor is connected, directly or through another component, to a circuit ground. The inductor serves to shunt a surge to ground. The inductor may be implemented in the form of a toroid, preferably in an insulated container to reduce the likelihood of any arcing. A series capacitor is connected between the signal conductor and the input or output port of the device to be protected, passes the desired signal, and further helps to prevent a surge from reaching the device.

A connector system has integrated surge protection to protect a device. The system includes a coaxial connector and an inductor. The coaxial connector includes a conductive connector body having a front end and a back end, a center conductor positioned inside the connector body and extending from the front end to, and out of, the back end, and at least one insulator positioned inside the connector body to electrically isolate the center conductor from the body. The inductor is positioned either at the back end of the connector or in a recessed area in the back end of the connector. One end of the inductor is connected to the center conductor. The inductor serves to shunt a surge to ground. The inductor may be implemented in the form of a toroid, preferably in an insulated container to reduce the likelihood of any arcing. A series capacitor is connected between the signal conductor and the input or output port of the device to be protected, passes the desired signal, and further helps to prevent a surge from reaching the device.

A coaxial connector system for providing surge protection to a device. The coaxial connector system includes a coaxial connector, an inductor, and a series capacitor. The coaxial connector includes a conductive connector body having a front end and a back end, a center conductor positioned inside the connector body and extending from the front end to, and out of, the back end, a first insulator positioned inside the connector body to electrically isolate the center conductor from the front end of the connector body, a second insulator positioned inside the connector body to electrically isolate the center conductor from the back end of the connector body, and an insulated container positioned either at the back end or in a recessed area in the back end. The inductor includes a toroid core having windings thereon, and the inductor is at least partially within the insulated container to reduce the likelihood of any arcing. One end of the windings is connected to the center conductor and to the series capacitor. The series capacitor is connected between the center conductor and the input or output port of the circuit to be protected, passes the desired signal, and further helps to prevent a surge from reaching the device. The other end of the windings is connected to a circuit ground via a connection to one of: the connector body, a circuit ground, another capacitor, a power supply, or a biasing circuit. The inductor serves to shunt a surge to ground.

DETAILED DESCRIPTION

Figure 1:
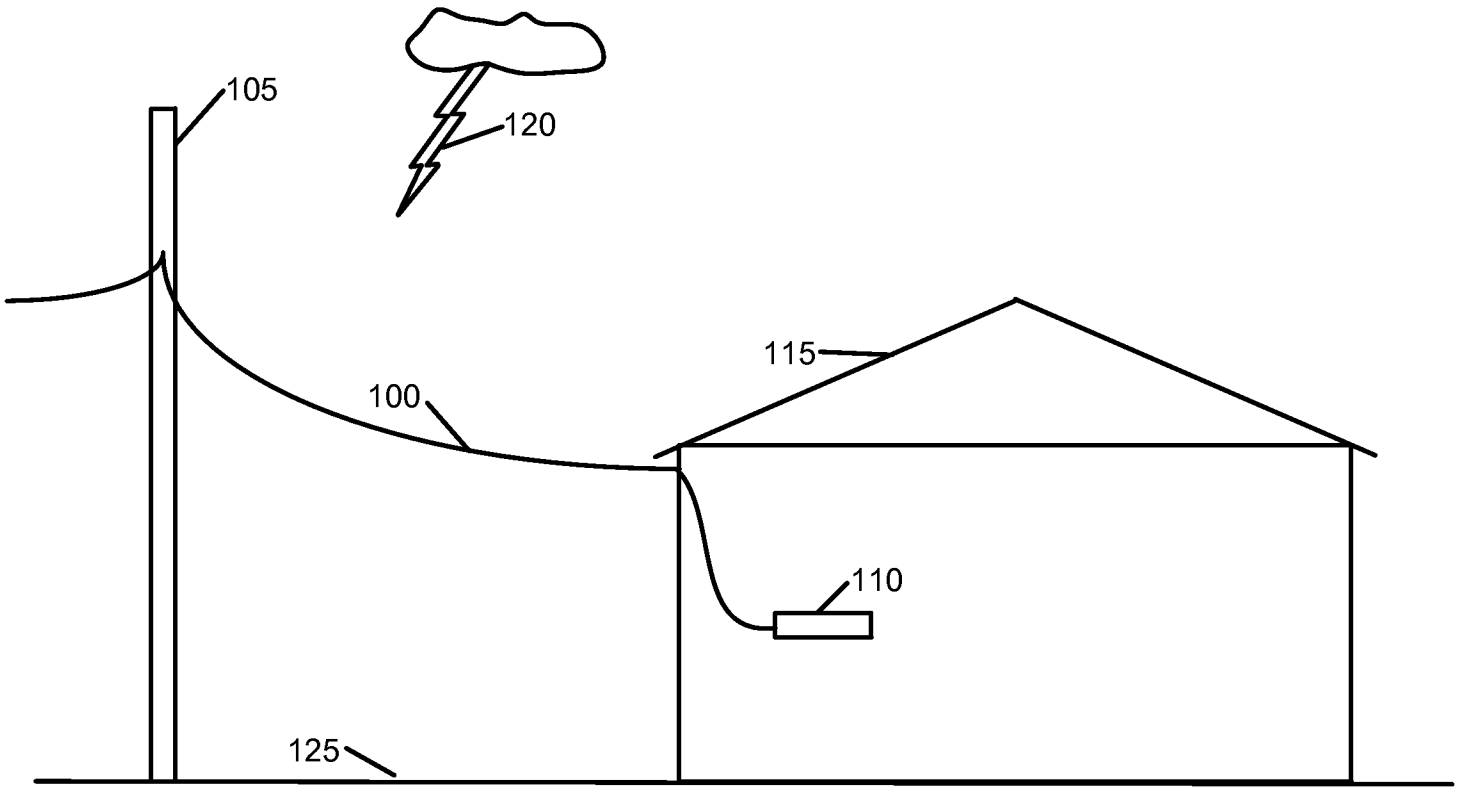
FIG. 1 is an illustration of a conventional cable connection system.

The following Detailed Description is directed to a cable connector with an included surge protector but is not limited to that type of connector and may be used with other types of connectors when surge protection is desired. In this Detailed Description references are made to the accompanying drawings, which form a part hereof, and that show by way of illustration various configurations or examples of the present disclosure. Referring now to the drawings, wherein like numerals represent like elements throughout the several figures, aspects of connectors with surge protection, including integrated surge protection, are presented.

Figure 2:
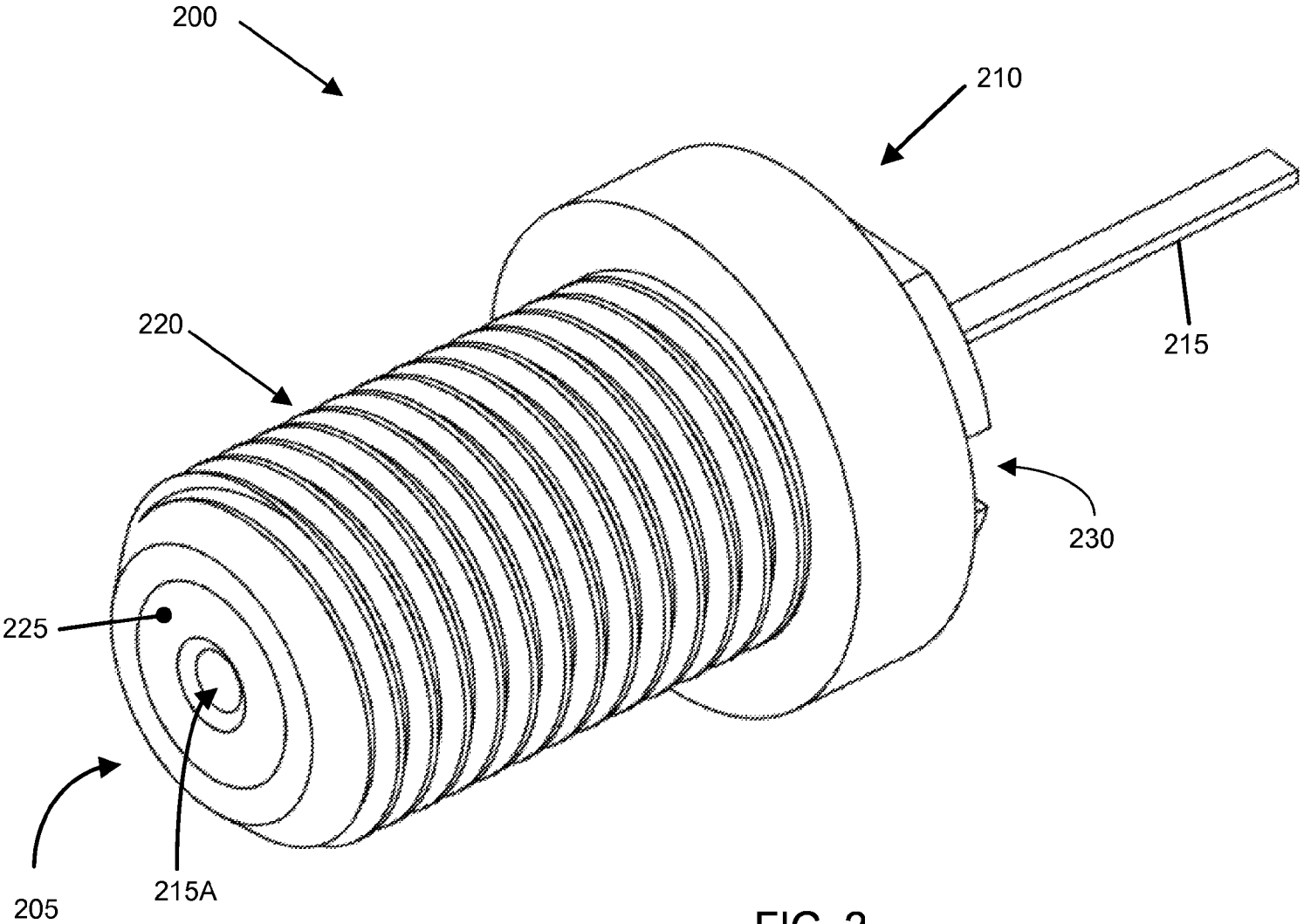
FIG. 2 is a front perspective diagram of an exemplary configuration of a female coaxial F-connector.

FIG. 2 is a front perspective diagram of an exemplary configuration of a female coaxial F-connector 200. The female connector 200 reversibly mates with a corresponding male connector (not shown) at the end of cable 100, typically by screwing the male and female connectors together. For convenience of discussion, and not by way of limitation or restriction, reference may be made herein to the "front" or "front end" of the F-connector 200, and to the "back", "back end", "rear" or "rear end" of the F-connector 200. The F-connector front end 205 is the end associated with connection to the coaxial cable 100. The F-connector back end 210 is the end opposite the F-connector front end 205, and is the end associated with connection to or within an electronic device 110. The body 220 is a conductive metal and is threaded to mate with the male F-connector. Extending from the front face 205 to, and out of, the back end of the connector 200 is a connecting lead 215 which preferably also forms the center conductor 215A in the face 205. The connecting lead 215 is typically connected to a printed circuit board (not shown) inside the device 110, such as, but not limited to, by soldering, ultrasonic welding, or another desired and appropriate technique. The connecting lead 215 may be referred to herein as a center conductor, a signal conductor, or a power conductor.

Figure 4:
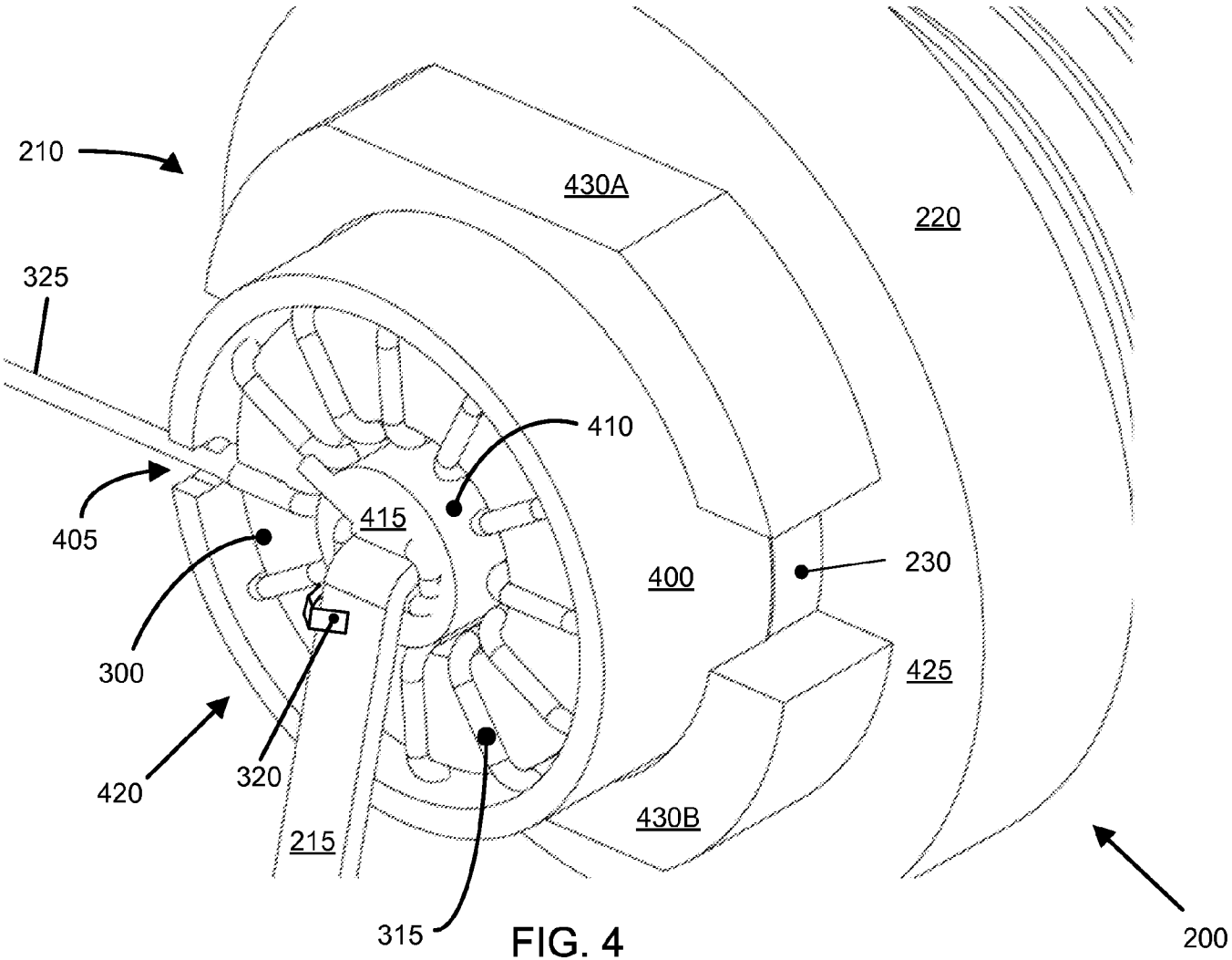
FIG. 4 is a rear perspective diagram showing the rear end of an exemplary female F-connector with a toroid cup and a toroid therein.
Figure 6:
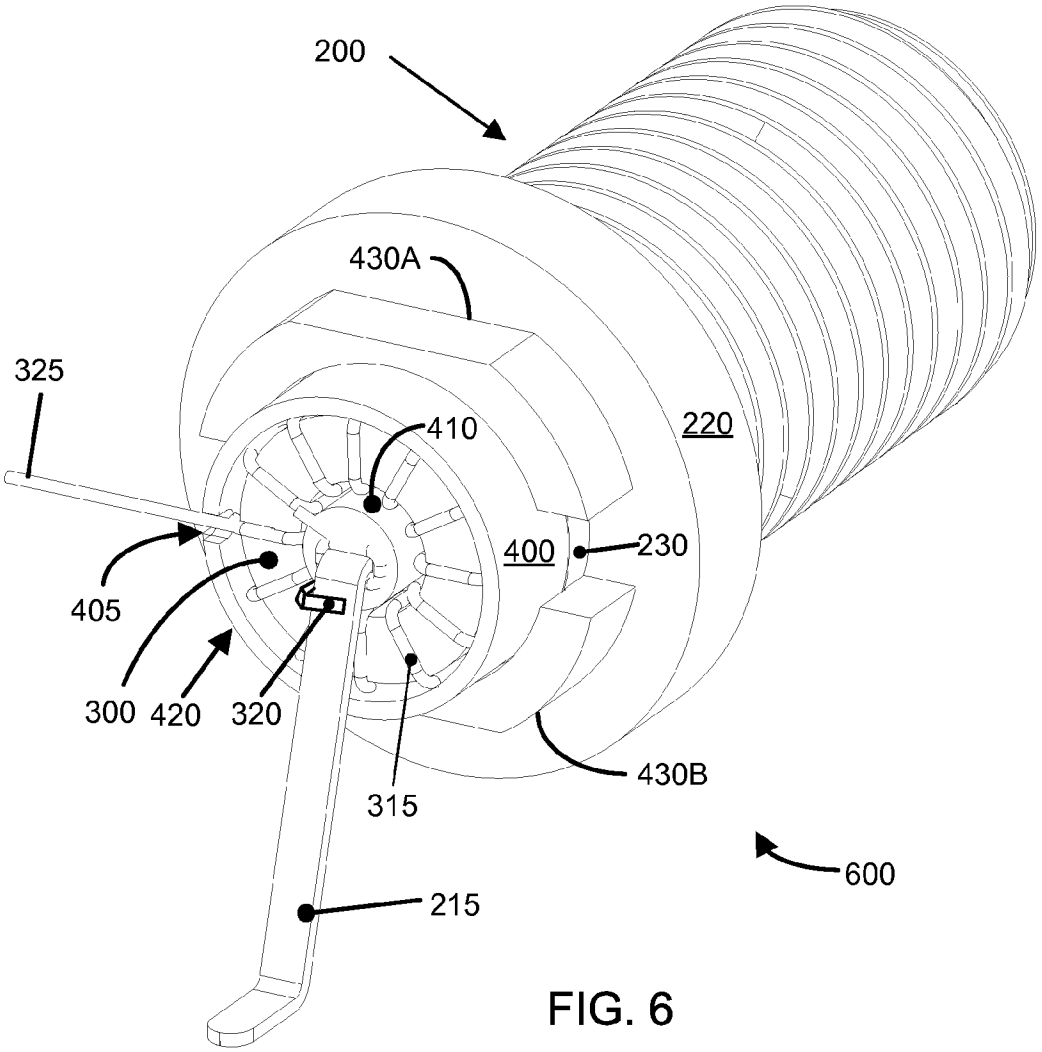
FIG. 6 is an illustration of an exemplary toroid assembly installed in an exemplary female coaxial connector.

The connecting lead 215 is electrically isolated from the body 220 by one or more insulators, such as but not limited to the insulator 225. The front insulator 225 includes a conductor receiving aperture 215A to receive the center conductor of the cable (not shown). Another insulator, denoted generally as 230 and better viewed in FIGS. 4 and 6, is at the back end of the connector body 220. These insulators function to position and hold the conductor 215 within, but not in electrical contact with, the connector body 220. In some configurations the back insulator 230 may be constructed to mate with the connecting lead 215 so that the connecting lead 215 is properly oriented. The back insulator 230 also comprises an aperture (not shown) through which the connecting lead 215 is inserted to be positioned and held. In other configurations the receiving apertures may be different configurations so as to accommodate a connecting lead 215 having a different shape and/or different shapes along its length.

Some details on the design and construction of the rear end 210 are shown in FIG. 4, and additional details of the design and construction of an exemplary female coaxial connector 200 usable as contemplated herein are disclosed in U.S. patent application Ser. No. 13/598,015, filed Aug. 29, 2012, by Earl Daughtry, et al., and entitled "F-Connector with Chamfered Lock Ring", the entirety of which is hereby incorporated herein by reference. The surge protection disclosed herein is not limited to use with only the connector disclosed in that patent application or in this patent application, nor limited to female F-connectors, but may be used with any connector which provides, or can be made to provide, a space suitable for mounting of a toroid 300 (FIG. 3) or a toroid assembly 420 (FIG. 4).

Figure 3:
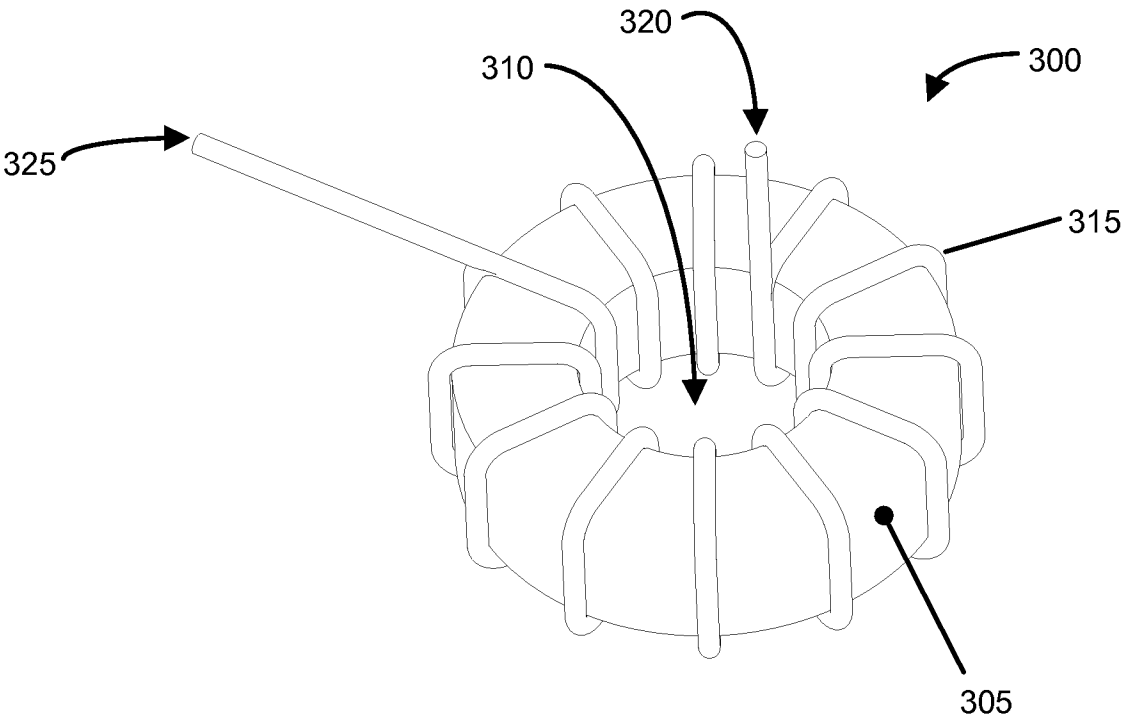
FIG. 3 is a perspective diagram showing an exemplary toroid element for use with a female coaxial connector.

FIG. 3 is a perspective diagram showing an exemplary toroid element 300 for use with a coaxial connector such as, but not limited to, the exemplary female F-connector 200 of FIG. 2. The illustrated toroid element 300 provides protection for the electronic device 110 from many of the surges on, or induced on, the coaxial cable 100. The illustrated toroid element 300 comprises a toroid core 305 having a center aperture 310 and a coil 315 which has a first end or lead 320 and a second end or lead 325.

Typically, the toroid core 305 is a ferrite compound and the coil 315 is an enamel wire. In alternative configurations the toroid core 305 may comprise a variety of shapes and dimensions, including cups, beads, sleeves, split "C" or "U" shapes, partial shapes such as a single "C" or angle, combinations thereof, and the like, the shape and dimension being merely a design choice. For present purposes, all of these various configurations are referred to in the singular or plural as 'core' or 'cores'.

The illustrated configuration shows a single solid core 305 and a single continuous coil or wire 315. Alternative configurations include a plurality of cores 305, such as but not limited to a stacked configuration. In addition, alternative configurations include a plurality of coils 315. In alternative configurations, the composition of a core and/or a coil may include ferrite, steel, copper, other metals, combinations thereof, and the like. It will be appreciated that surges are generally low-frequency waveforms as compared with the frequencies of interest for most cable communications. The number of cores 305, coils 315, and windings of the coil(s) 315 around the core(s) 305 are selected to provide a relatively high impedance, that is, high relative to the impedance of the coaxial cable 100 and the input impedance of the device 110 at the signal frequencies of interest, so as not to adversely affect the signal being transmitted over the cable 100, and to provide a low relatively impedance at lower frequencies and/or direct current (DC), so as to shunt any surges.

FIG. 4 is a rear perspective diagram showing the rear end 210 of an exemplary female F-connector 200 with a toroid cup 400 and a toroid 300 therein. Also shown are connecting lead 215, one of the leads 325 of the toroid 300, and a cutout 405 in the cup 400 to allow lead 325 of the toroid 300 to exit the cup 400 for connection to a desired electrical conductor (FIGS. 7A and 7B), a center channel or guide 410 which surrounds the lead 215 and forms an aperture 415 through which the lead 215 extends, and the back insulator 230.

In one configuration the toroid 300 is used without the toroid cup 400. This, however, is not the preferred configuration because, during manufacturing and/or installation, or even just due the stress of the wire 315 being sharply bent around the toroid core 305, the insulation on the wire 315 may become cracked or chipped at one or more points. If that occurs then, during a surge, arcing may occur between such a point and the conducting lead 215 and/or the body 220 of the connector 200. Such arcing creates a short circuit across part of the inductor (toroid 300), thereby affecting the signal quality and level. Such arcing can also produce voltage transients and/or electromagnetic interference which can interfere with circuit operation and/or damage electronic circuit components which are nearby or are connected thereto.

To reduce the likelihood of such arcing, the toroid assembly 300 is preferably positioned within a toroid cup 400 that is at the rear end of, or within the rear end of, the connector 200. The toroid cup 400 is constructed of insulating materials. The toroid cup 400 provides an additional layer of insulation which reduces the likelihood of sparking or arcing even if the insulation on the wire 315 has been damaged. The toroid 300 is placed inside the toroid cup 400 to form a toroid assembly 420.

In one configuration the toroid assembly 420 is positioned by threading the connecting lead 215 through the center aperture 415, such that the toroid assembly 420 surrounds the connecting lead 215. The toroid assembly 420 is then pressed against the rear face 425 of the connector 200. In one configuration, the rear end of the connector 200 is deep enough that the toroid 300 and cup 400 may be placed inside the body 220 of the connector 200. In another configuration, the toroid assembly 420 is nested within a space formed by, for example but not limited to, indexing keys 430A and 430B on the rear face 425 of the connector 200. For example, the indexing keys 430A and 430B (FIG. 6) 230 may be long enough and have an inner diameter large enough to cradle the cup 400. If desired, the toroid assembly 420 may be affixed to the rear face 425 by a suitable bonding agent. The cup 400 may be filled with an appropriate potting material to secure the toroid 300 in the cup 400, prevent damage to the windings 315 of the toroid 300, provide protection for the toroid 300 against moisture, vibration, and/or other environmental conditions, etc.

Figure 5B:
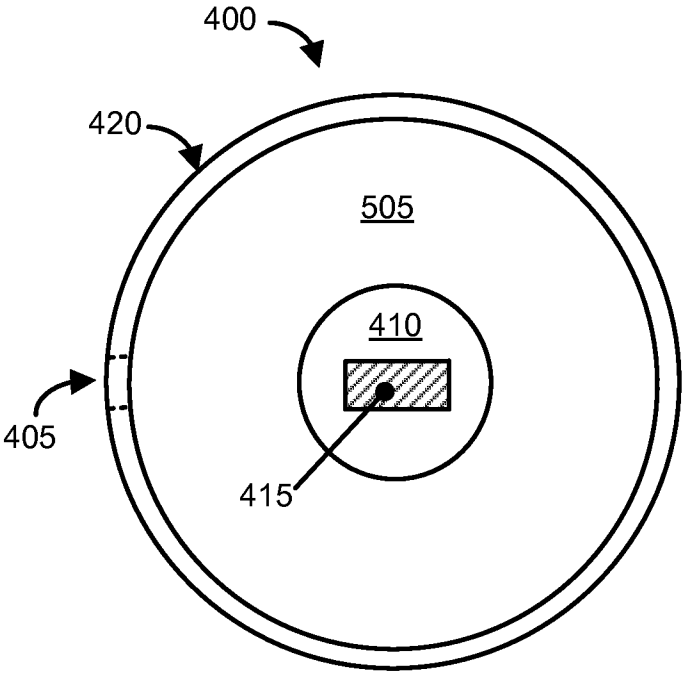
FIGS. 5A and 5B are side and plan views, respectively, of an exemplary toroid cup.
Figure 5A:
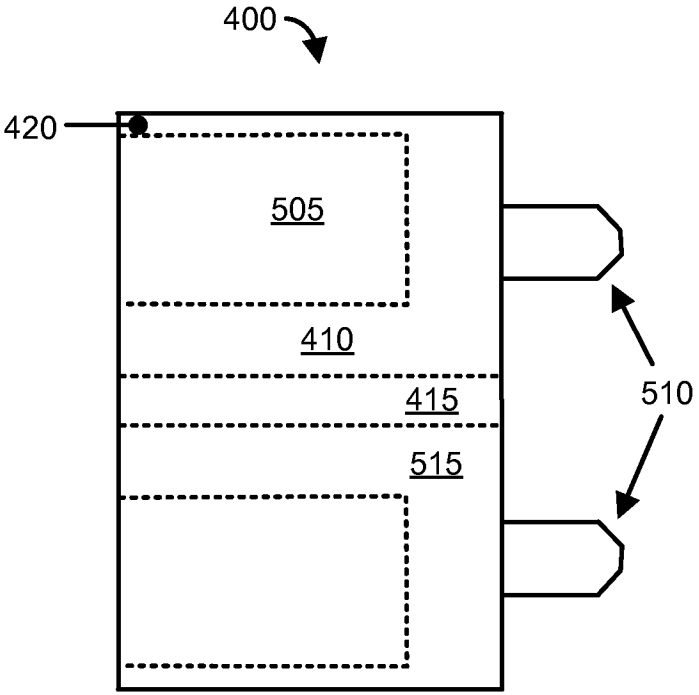

FIGS. 5A and 5B are side and plan views, respectively, of an exemplary toroid cup 400. The cup 400 has a base 515, a circular inner wall or tube 410, and a circular outer wall or tube 420. The inner wall 410 defines a channel or an aperture 415 which goes completely through the cup 400 and through which the connecting lead 215 is inserted. The space between the inner wall 410 and the outer wall 420 defines a volume 505 in which the toroid 300 is placed. Also shown are the cutout 405 and optional, but preferred, indexing lugs or rings 510 which serve to align the position of the toroid cup 400 in the connector 200 so that conductor 215 is properly aligned for installation on and connection to a circuit board (not shown), and so that the coil end 325 and cutout 405 are properly positioned for connection to another component (not shown). The rectangular shape of aperture 415 is not necessary but is preferred so as to help align conductor 215 for installation on and connection to a circuit board (not shown).

FIG. 6 is an illustration of an exemplary toroid assembly 420 installed in an exemplary female coaxial connector 200, showing the lead 325 extending through the cutout area 405, and further showing the lead 215 being optionally bent so that the surge-protected female F-connector assembly 600 may be conveniently mounted to, for example, a printed circuit board. The lead 215, bent in the manner shown, may also serve to retain the toroid assembly 420, especially if a bonding agent is not used to secure the toroid assembly 420 to the connector 200. After the toroid assembly 420 is installed in the connector 200, and either before or after the lead 215 is bent, if desired, then the lead 320 of the toroid assembly 420 is secured to the lead 215, such as by, but not limited to, soldering, ultrasonic welding, or another desired and appropriate technique.

Figure 7A:
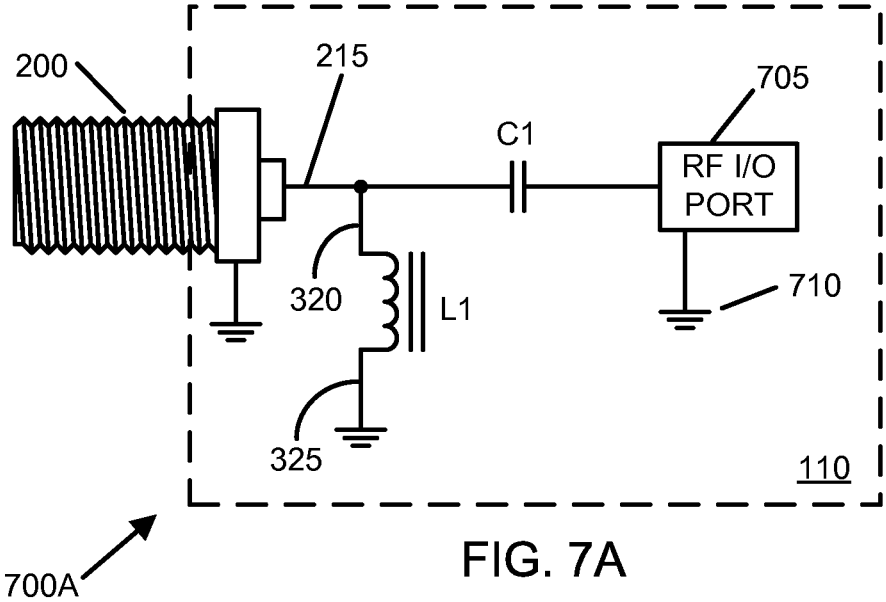
FIGS. 7A and 7B are schematic diagrams of two exemplary devices which are protected against surges.
Figure 7B:
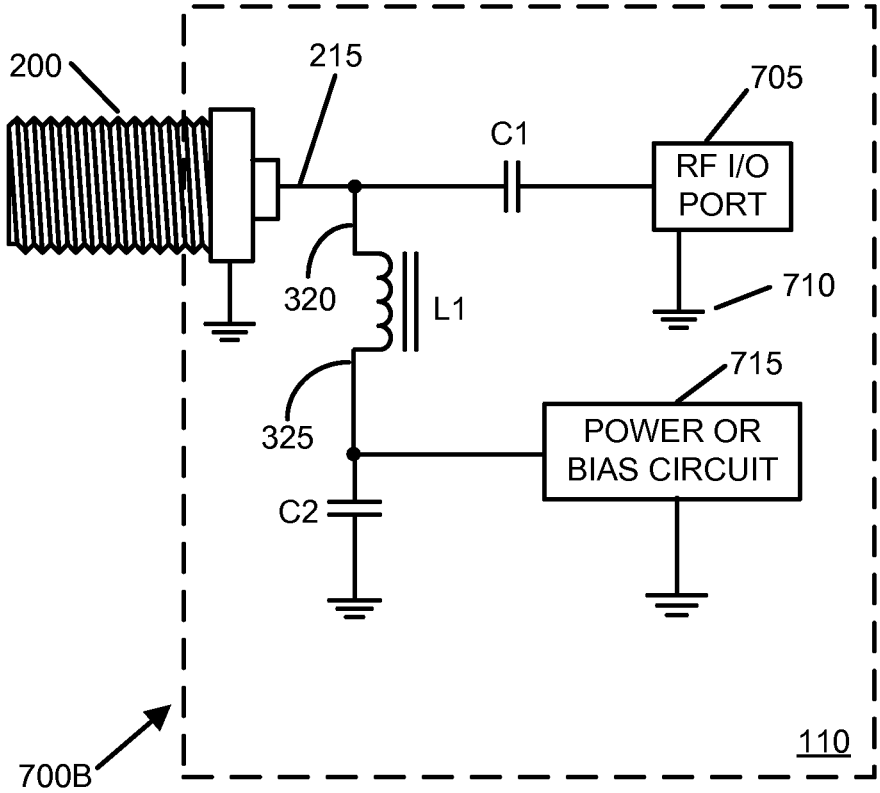

FIGS. 7A and 7B are schematic diagrams of two exemplary devices 110 which are protected against surges. With reference now to FIG. 7A, there is shown a first schematic 700A illustrating an F-connector 200 which is connected to an input, output, or input/output port 705 of an electronic device 110, such as but not limited to an RF input port of a cable modem receiver. In this configuration signals are transmitted to/from the device 110 via the cable 100 (FIG. 1) which is connected to the connector 200, but DC power is not transmitted. A series capacitor C1 and a parallel or shunting inductor L1, such as the toroid 300, form part of a high-pass filter between the connector 200 and the port 705. The connecting lead 215 of the connector 200 is connected to one end of the capacitor C1, and to one of the leads, such as lead 320, of the toroid 300. The other end of the capacitor C1 is connected to the port 705 of the connected device 110. The other lead of the toroid 300, such as lead 325, is connected to a circuit ground 710, such as but not limited to an element of the device 110 or even to the body of the F-connector 200. Thus, the capacitor C1 blocks, and the toroid 400 shunts to ground, any low frequency or direct current surges or static electricity which may appear on the cable 100. Therefore, the port 705 of the device 110 is protected.

With reference to FIG. 7B, there is shown a second schematic 700B, which is similar to the schematic 700A but, in this configuration, both signals and power may be transmitted to/from the device 110 via the cable 100 which is connected to the connector 200. In this configuration, however, the lead 325 of the toroid 300 is connected to a power supply or bias circuit 715 and to one end of a capacitor C2, the other end of which capacitor C2 is connected to circuit ground 710. The device 110 may provide bias or power via the cable 100 to another device (not shown), or the device 110 may receive bias or power via the cable 100 from another device (not shown). Thus, the capacitor C1 blocks, and the toroid 400 shunts to the power or bias circuit 715, any low frequency or direct current surges or static electricity which may appear on the cable 100. Capacitor C2 serves to absorb part of any surge which may appear so as not to overstress the circuit 715, and also absorbs any high frequency signals which may make it through inductor L1. Therefore, the port 705 of the device 110 is again protected.

In one configuration of circuits 700A and 700B, capacitor C1 has a value between 470 and 1000 picofarads (pf), and inductor L1 has a value of approximately 8.3 microhenries (μH). The nominal impedance (75 ohms) of the cable 100 and the nominal input impedance of the port 705, along with these values for L1 and C1, form a high-pass filter has a nominal cutoff frequency of approximately 5 Megahertz (MHz). These values and this cutoff frequency are merely exemplary, and other values may be used as desired to achieve a desired cutoff frequency with a particular cable impedance and port input impedance. Capacitor C2 of circuit 700B has a nominal value of 10,000 pf. This value is not critical and other values may be used. In one configuration, L1 comprises 8 to 10 turns of insulated wire wound on an FT23 toroid core having an inner diameter of 0.12 inches and an outer diameter of 0.23 inches.

Preferably, and as shown in FIGS. 4 and 6, the inductor L1/toroid 300 is placed at or in the rear end of the connector 200, rather than in or at port 705. This serves to absorb any incoming transient or surge at the point of the connector 200, rather than further inside the device 110, and minimizes the radiation of any EMI inside the device 110. In practice, the components 200, L1, C1 and 705, and components C2 and 715 if used, are preferably closely mounted on a printed circuit board (PCB) in the device 110, and are preferably connected by conductive traces on the PCB. For example, the lead 215 and one end of capacitor C1 would be connected by soldering them to a conductive trace on the PCB, the other end of capacitor C1 and the input/output of the port 705 would be connected by soldering them to another conductive trace on the PCB. Also, in circuit 700A, the lead 325 would be soldered to a ground trace, preferably the same ground trace to which the body of connector 200 is soldered. Similarly, in circuit 700B, the lead 325, one end of capacitor C2, and the input/output of the circuit 715 would be connected by soldering them to another conductive trace on the PCB. The other end of capacitor C2 would be soldered to a ground trace, preferably the same ground trace to which the body of connector 200 is soldered. Preferably, the components and conductive traces are arranged so as to minimize the length of any traces which are used to shunt a surge.

Based on the foregoing, it should be appreciated that a connector with built-in surge suppression is disclosed. It will also be appreciated that a connector with built-in surge suppression provides advantages in the manufacturing of PCBs used in electronic devices. By shunting the surge at an early point, that is, at the connector, the likelihood is reduced that the surge will cause interference or damage to other components and circuits on the PCB and/or in the electronic device. Also, as the connector is provided with the inductor (toroid) already attached, there is one less component that must be placed on and soldered to the PCB. Furthermore, as the connector is provided with the inductor (toroid) already attached at the back end of the connector, less space is required on the PCB than if the inductor had to be separately mounted on the PCB. Thus, savings in cost and time in manufacturing, and in PCB space, can be realized. It should also be appreciated that the subject matter described above is provided by way of illustration only and should not be construed as limiting. Various modifications and changes may be made to the subject matter described herein without following the example configurations and applications illustrated and described, and without departing from the scope of the present invention, which is set forth in the following claims.

The invention claimed is:

1. A connector with integrated surge protection, comprising:

a conductive connector body having a front end and a back end;

a signal conductor, positioned inside the connector body, and extending from the front end to, and out of, the back end;

at least one insulator positioned inside the connector body to electrically isolate the signal conductor from the connector body;

an inductor having a first end and a second end, the first end being connected to the signal conductor, the inductor being positioned either at the back end or in a recessed area in the back end; and an insulated container to at least partially enclose the inductor.

2. The connector of claim 1 wherein the inductor comprises a toroid core having a plurality of windings thereon, the plurality of windings having said first end and said second end.

3. The connector of claim 2 wherein the toroid core has a center channel, and wherein the signal conductor passes though the center channel.

4. The connector of claim 1 wherein the second end is electrically connected to the connector body.

5. The connector of claim 1 wherein the second end is electrically connected to a circuit ground.

6. The connector of claim 1 wherein the at least one insulator comprises a first insulator to electrically isolate the signal conductor from the front end of the connector body.

7. The connector of claim 6 and further comprising a second insulator to electrically isolate the signal conductor from the back end of the connector body.

8. The connector of claim 1 wherein the conductive connector body, the signal conductor, and the at least one insulator are part of a coaxial connector.

9. A connector system providing surge protection, comprising:

a coaxial connector comprising:

a conductive connector body having a front end and a back end;

a center conductor, positioned inside the connector body, and extending from the front end to, and out of, the back end;

at least one insulator positioned inside the connector body to electrically isolate the center conductor from the connector body; and an inductor having a first end and a second end, the first end being connected to the center conductor, the inductor being positioned either at the back end or in a recessed area in the back end; and a first capacitor connected in series between the center conductor and a circuit to be protected.

10. The connector system of claim 9 wherein the inductor comprises a toroid core having a plurality of windings thereon, the plurality of windings having said first end and said second end.

11. The connector system of claim 10 wherein the toroid core has a center channel, and wherein the center conductor passes though the center channel.

12. The connector system of claim 9 wherein the second end electrically connected to the connector body.

13. The connector system of claim 9 wherein the second end is electrically connected to a circuit ground.

14. The connector system of claim 9 and further comprising a second capacitor connected between the second end and a circuit ground.

15. The connector system of claim 9 and further comprising an insulated container to at least partially enclose the inductor.

16. The connector system of claim 9 wherein the at least one insulator comprises a first insulator to electrically isolate the center conductor from the front end of the connector body.

17. The connector system of claim 16 and further comprising a second insulator to electrically isolate the center conductor from the back end of the connector body.

18. A coaxial connector system for providing surge protection, comprising:

a coaxial connector comprising:

a conductive connector body having a front end and a back end;

a center conductor, positioned inside the connector body, and extending from the front end to, and out of, the back end;

a first insulator positioned inside the connector body to electrically isolate the center conductor from the front end of the connector body;

a second insulator positioned inside the connector body to electrically isolate the center conductor from the back end of the connector body; and an insulated container positioned either at the back end or in a recessed area in the back end;

an inductor comprising a toroid core having a plurality of windings thereon, the plurality of windings having a first end and a second end, the first end being connected to the center conductor, the inductor being at least partially within the insulated container;

a series capacitor connected between the center conductor and a circuit to be protected; and wherein the second end of the plurality of windings is connected to a circuit ground via a connection to a predetermined one of: (1) the connector body, (2) a circuit ground, (3) another capacitor, (4) a power supply, or (5) a biasing circuit.

* * * * *